US011670887B2

(12) United States Patent
Yu et al.

(10) Patent No.: US 11,670,887 B2
(45) Date of Patent: Jun. 6, 2023

(54) PROTECTION COVER DEVICE FOR SOCKET AND SOCKET

(71) Applicants: OPPLE LIGHTING CO., LTD., Shanghai (CN); SUZHOU OPPLE LIGHTING CO., LTD., Suzhou (CN)

(72) Inventors: Guoqiang Yu, Shanghai (CN); Canyan Xie, Shanghai (CN); Hejun Sun, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 162 days.

(21) Appl. No.: 17/362,915

(22) Filed: Jun. 29, 2021

(65) Prior Publication Data

US 2021/0328378 A1 Oct. 21, 2021

Related U.S. Application Data

(63) Continuation of application No. PCT/CN2019/128268, filed on Dec. 25, 2019.

(30) Foreign Application Priority Data

Dec. 30, 2018 (CN) ..... 201822262311.1

(51) Int. Cl.
*H01R 29/00* (2006.01)
*H01R 13/453* (2006.01)
*H01R 43/18* (2006.01)

(52) U.S. Cl.
CPC ..... *H01R 13/4538* (2013.01); *H01R 43/18* (2013.01)

(58) Field of Classification Search
CPC ..... H01R 29/00; H01R 27/00; H01R 13/03; H01R 25/58; H01R 4/34; H01R 13/652; H01R 13/6397
See application file for complete search history.

(56) References Cited

U.S. PATENT DOCUMENTS 6,776,630 B1 8/2004 Huang
6,786,745 B1 9/2004 Huang
(Continued)

FOREIGN PATENT DOCUMENTS

CN 204349011 U 5/2015
CN 209692024 U 11/2019
(Continued)

OTHER PUBLICATIONS

International Search Report of PCT Application No. PCT/CN2019/128268 dated Mar. 24, 2020 with English translation, (4p).

*Primary Examiner* — Phuong Chi Thi Nguyen
(74) *Attorney, Agent, or Firm* — Arch & Lake LLP

(57) ABSTRACT

The present disclosure discloses a protection cover device for socket, which includes a housing, a protection cover which is arranged in the housing, and a torsion spring which is configured to reset the protection cover, the housing includes a bottom plate and a faceplate spaced apart from the bottom plate, the faceplate is provided with a first insertion hole and a second insertion hole, the bottom plate is provided with a first through hole and a second through hole; the protection cover is provided with a first driving slope and a second driving slope that guide the protection cover to translate along a distribution direction of the first insertion hole and the second insertion hole, the protection cover is further provided with a probe hole, and the torsion spring includes a spring body, a first swinging arm and a second swinging arm.

17 Claims, 5 Drawing Sheets

(56) References Cited

U.S. PATENT DOCUMENTS

| | | | | |
|---|---|---|---|---|
| 9,502,807 | B2 * | 11/2016 | Mortun | H01R 13/4534 |
| 9,543,715 | B2 * | 1/2017 | Savicki, Jr. | H01R 13/4532 |
| 9,761,985 | B1 * | 9/2017 | Peng | H01R 13/4534 |
| 11,469,535 | B1 * | 10/2022 | Satyanarayanan | H01R 24/78 |
| 2022/0336970 | A1 * | 10/2022 | Nagayama | H01R 13/50 |
| 2022/0336991 | A1 * | 10/2022 | Nagayama | H01R 4/34 |

FOREIGN PATENT DOCUMENTS

| | | | |
|---|---|---|---|
| GB | 1438209 | A | 6/1976 |
| WO | 2007071129 | A1 | 6/2007 |

* cited by examiner

PROTECTION COVER DEVICE FOR SOCKET AND SOCKET

CROSS-REFERENCE TO RELATED APPLICATIONS

This application is based upon and claims the priority of PCT patent application No. PCT/CN2019/128268 filed on Dec. 25, 2019 which claims priority to the Chinese patent application No. 201822262311.1 filed on Dec. 30, 2018, the entire content of both of which is hereby incorporated by reference herein for all purposes.

TECHNICAL FIELD

The present disclosure relates to the field of socket technology, and in particular, to a protection cover device for a socket and a socket.

BACKGROUND

Socket is an electrical device that provides a power interface for electrical appliances, and socket is also an electrical accessory that is frequently used in the electrical design of buildings.

SUMMARY

The present disclosure provides a protection cover device for a socket, a socket and a method of manufacturing a socket.

The present disclosure provides a protection cover device for a socket. The protection cover device may include a housing, a protection cover which is arranged in the housing, and a torsion spring which is configured to reset the protection cover. The housing may include a bottom plate and a faceplate spaced apart from the bottom plate, the faceplate is provided with a first insertion hole and a second insertion hole, the bottom plate is provided with a first through hole and a second through hole; the protection cover is further provided with a first driving slope and a second driving slope that guide the protection cover to translate along a distribution direction of the first insertion hole and the second insertion hole, the protection cover is further provided with a probe hole.

The torsion spring may include a spring body, a first swinging arm fixedly connected to the spring body and a second swinging arm fixedly connected to the spring body, the torsion spring is arranged between the protection cover and the bottom plate, where the spring body may be lap jointed or connected with the protection cover, the first swinging arm may be lap jointed with a surface of the bottom plate and may be configured to slide along the surface of the bottom plate upon the protection cover being pressed down and translated, and the second swinging arm may be connected or lap-jointed with the bottom plate.

The present disclosure provides a socket. The socket may include a socket container, a first socket sleeve and a second socket sleeve arranged in the socket container, and a protection cover device for the socket.

The protection cover device may include a housing; a protection cover, which is arranged in the housing; and a torsion spring, which is configured to reset the protection cover. The housing may include a bottom plate and a faceplate spaced apart from the bottom plate, the faceplate is provided with a first insertion hole and a second insertion hole, the bottom plate is provided with a first through hole and a second through hole; the protection cover is further provided with a first driving slope and a second driving slope that guide the protection cover to translate along a distribution direction of the first insertion hole and the second insertion hole, the protection cover is further provided with a probe hole; the torsion spring comprises a spring body, a first swinging arm fixedly connected to the spring body and a second swinging arm fixedly connected to the spring body, the torsion spring is arranged between the protection cover and the bottom plate.

The spring body may be lap-jointed or connected with the protection cover, the first swinging arm may be lap jointed with a surface of the bottom plate and may be configured to slide along the surface of the bottom plate upon the protection cover being pressed down and translated, and the second swinging arm may be connected or lap-jointed with the bottom plate, and the protection cover device may be arranged above the first socket sleeve and the second socket sleeve, the first insertion hole may be aligned with the first socket sleeve, and the second insertion hole may be aligned with the second socket sleeve.

The protection cover device is arranged above the socket sleeves, the first insertion hole is aligned with the first socket sleeve, and the second insertion hole is aligned with the second socket sleeve.

The present disclosure provides a method of manufacturing a socket. The method may include providing a socket container, and arranging a first socket sleeve and a second socket sleeve in the socket container; providing a protection cover device that comprises a housing, a protection cover which is arranged in the housing; and a torsion spring which is configured to reset the protection cover; providing the housing with a bottom plate and a faceplate spaced apart from the bottom plate, providing the faceplate with a first insertion hole and a second insertion hole, providing the bottom plate with a first through hole and a second through hole; providing the protection cover with a first driving slope and a second driving slope that guide the protection cover to translate along a distribution direction of the first insertion hole and the second insertion hole, providing the protection cover with a probe hole.

The method may also include providing the torsion spring with a spring body, a first swinging arm fixedly connected to the spring body and a second swinging arm fixedly connected to the spring body, and arranging the torsion spring between the protection cover and the bottom plate, and lap-jointing or connecting the spring body with the protection cover, where the first swinging arm may be lap jointed with a surface of the bottom plate and may be configured to slide along the surface of the bottom plate upon the protection cover being pressed down and translated, and connecting or lap jointing the second swinging arm with the bottom plate, and arranging the protection cover device above the first socket sleeve and the second socket sleeve, aligning the first insertion hole with the first socket sleeve, and aligning the second insertion hole with the second socket sleeve.

It is to be understood that both the foregoing general description and the following detailed description are exemplary and explanatory only and are not restrictive of the present disclosure.

DETAILED DESCRIPTION

Figure 1:
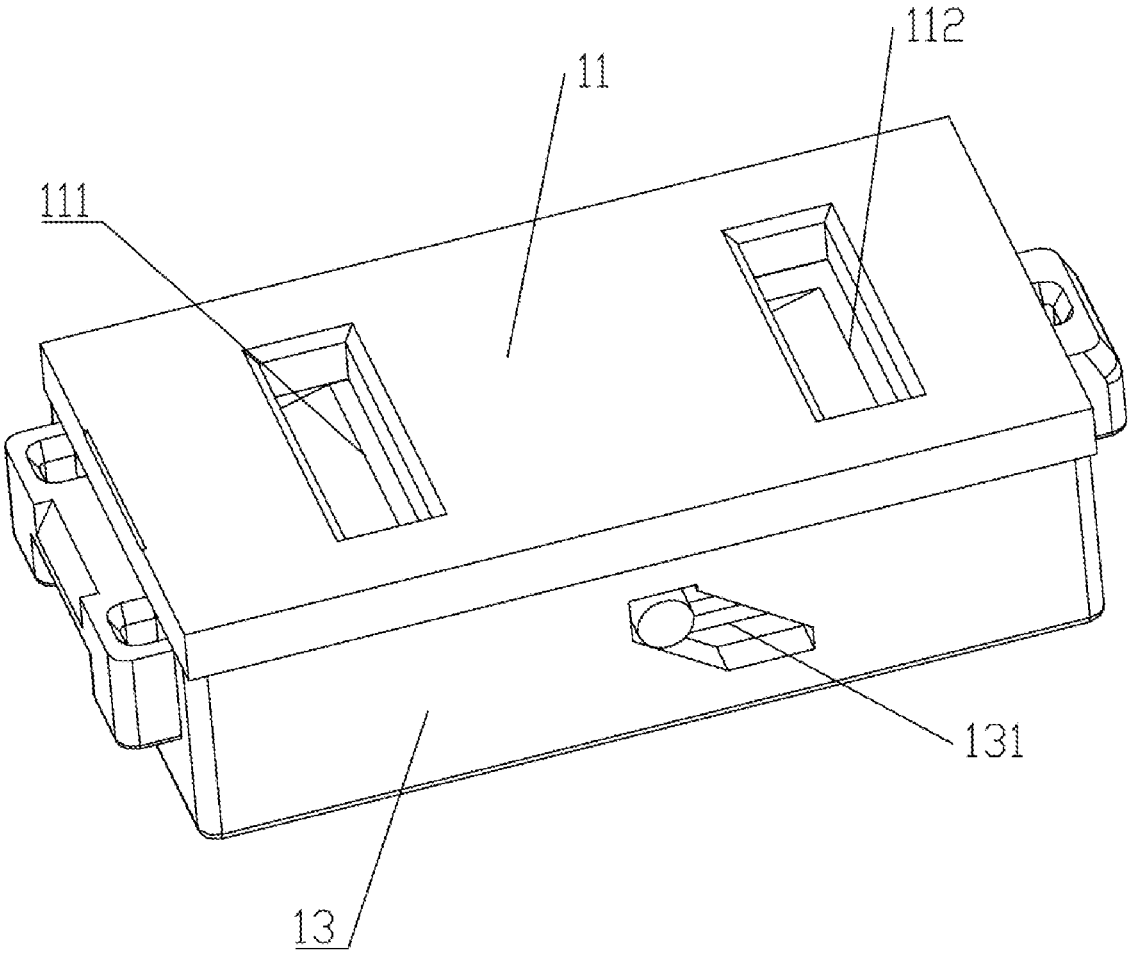
FIG. 1 is a perspective view of a protection cover device for socket according to examples of the present disclosure.

The specific implementation of the present disclosure will be described in further detail below with reference to the drawings and examples. The following examples are used to illustrate the present disclosure, but not to limit the scope of the present disclosure.

Reference numerals used in this disclosure may include: 10: housing; 11: faceplate; 111: first insertion hole; 112: second insertion hole; 113: first stopper; 12: bottom plate; 121: first through hole; 122: second through hole; 123: first through hole guide plate; 124: second through hole guide plate; 13: enclosure plate; 131: sliding groove; 20: protection cover; 21: first driving slope; 22: second driving slope; 23: probe hole; 24: shaft head; 25: second stopper; 30: torsion spring; 31: spring body; 32: first swinging arm; 33: second swinging arm; 40: plug; 41: first plug probe; 42: second plug probe; 50: socket container; 51: first socket sleeve; 52: second socket sleeve.

In order to improve the electrical safety of the socket, a protection structure is usually provided in the socket. The protection structure is set above socket sleeves of the socket. When a plug is inserted into the socket, the protection structure is driven to open. After the plug is pulled out, the protection cover will be automatically reset and blocked above the socket sleeves under the action of a reset spring to prevent objects from entering the socket sleeves by mistake and prevent electric shock. Sockets that meet the requirements of national standards must have the function of anti-unipolar insertion. When an object is inserted into only one of the insertion hole corresponding to the L-pole socket sleeve and the insertion hole corresponding to the N-pole socket sleeve, the protection structure cannot be opened. Some reset springs are compression springs, and some are torsion springs. Sometimes, the reliability of some protection cover devices for socket is relatively poor, and it is easy to cause accidental insertion, or the socket protection cover devices are stuck, which affects normal use.

Refer to FIG. 1 to FIG. 4, a protection cover device for socket according to an example of the present disclosure includes a housing 10, a protection cover 20 located in the housing 10, and a torsion spring 30 which is configured to reset the protection cover 20.

Figure 2:
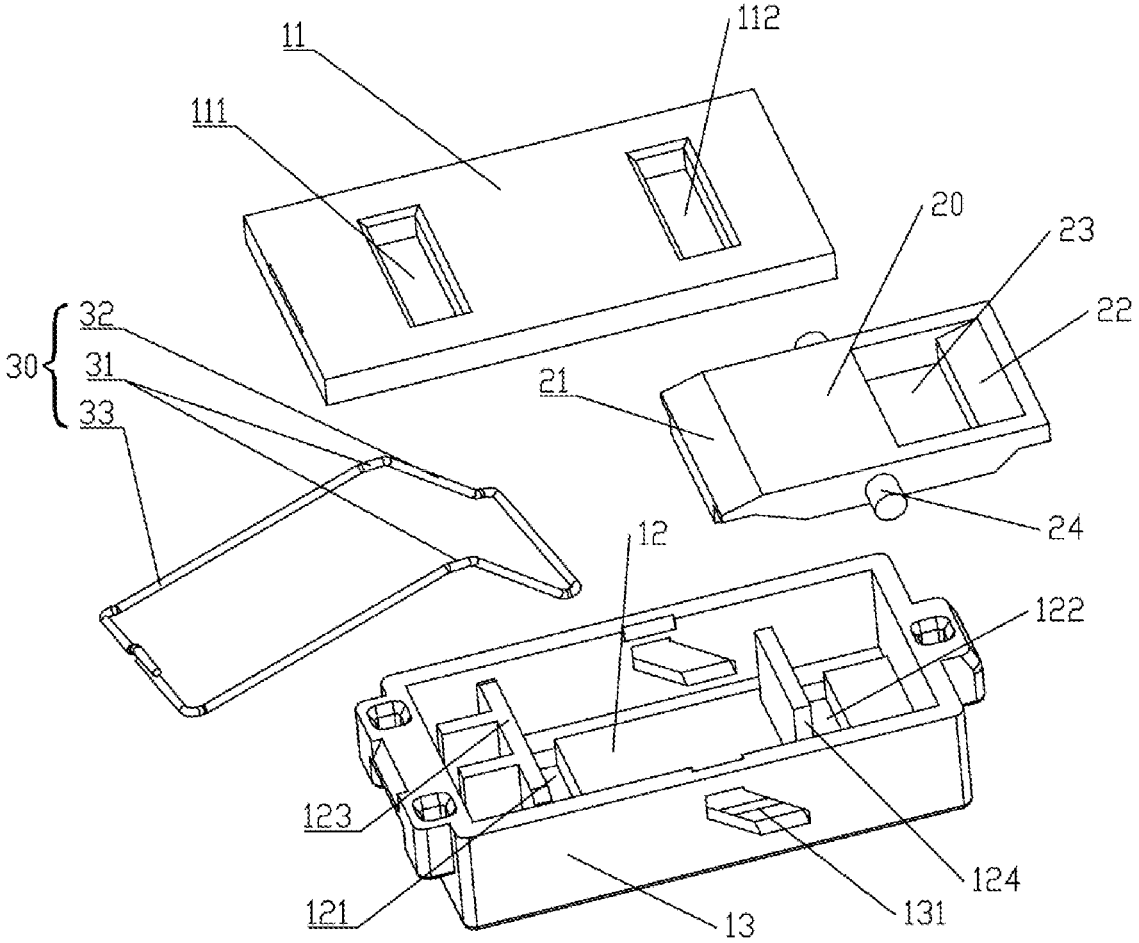
FIG. 2 is an exploded view of a protection cover device for socket according to examples of the present disclosure.
Figure 3:
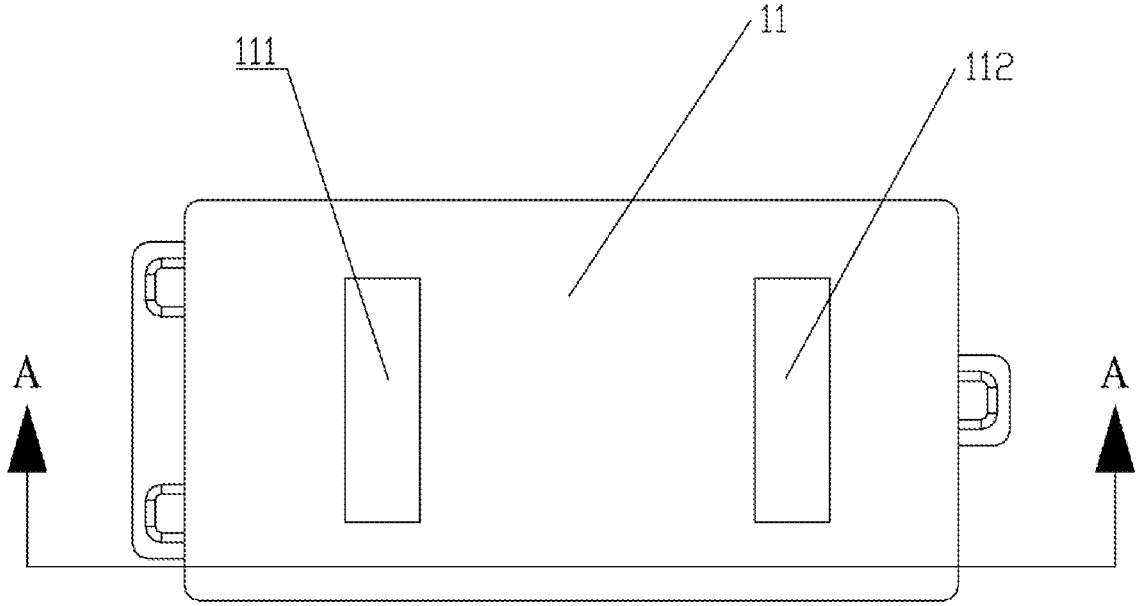
FIG. 3 is a front view of a protection cover device for socket according to examples of the present disclosure.

The housing 10 includes a bottom plate 12 and a faceplate 11 spaced apart from the bottom plate 12. As shown in FIG. 1 to FIG. 4, in the example, an enclosure plate 13 is provided between the bottom plate 12 and the faceplate 11 along the height direction. In other examples, the enclosure plate may also be formed by the socket housing. The faceplate 11 is provided with a first insertion hole 111 and a second insertion hole 112. As shown in FIG. 2, the bottom plate 12 is provided with a first through hole 121 and a second through hole 122, and the first through hole 121 and the second through hole 122 are respectively for the plug probes inserted from the first insertion hole 111 and the second insertion hole 112 to pass through.

Figure 4:
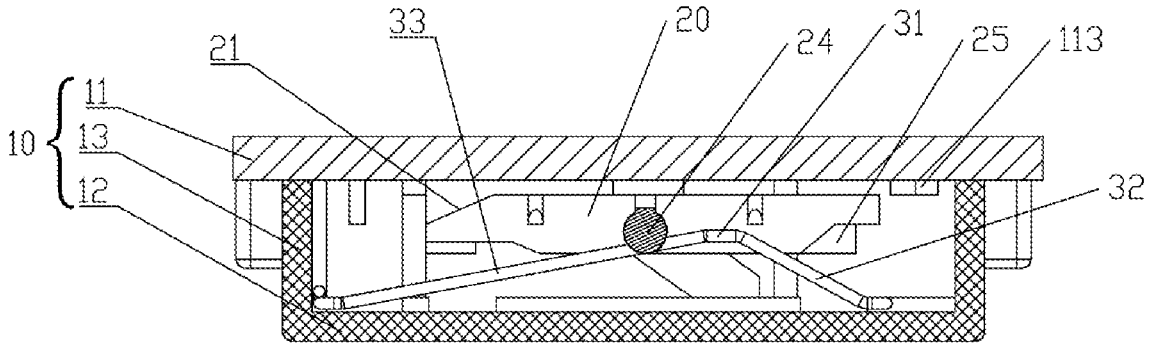
FIG. 4 is a cross-sectional view of the protection cover device for socket taken along direction A-A shown in the front view according to examples of the present disclosure (normal state)

The protection cover 20 is provided with a first driving slope 21 and a second driving slope 21 that guide the protection cover 20 to translate along a distribution direction of the first insertion hole 111 and the second insertion hole 112. The protection cover 20 is further provided with a probe hole 23. As shown in FIG. 2 and FIG. 4, the first driving slope 21 inclines upward from the edge of the protection cover 20 to the middle of the protection cover 20, and the second driving slope 22 inclines upward from the edge of the probe hole 23 to the edge of the protection cover 20. The inclination directions of the first driving slope 21 and the second driving slope 22 are approximately the same, and the gradients of the first driving slope 21 and the second driving slope 22 are approximately the same.

Figure 5:
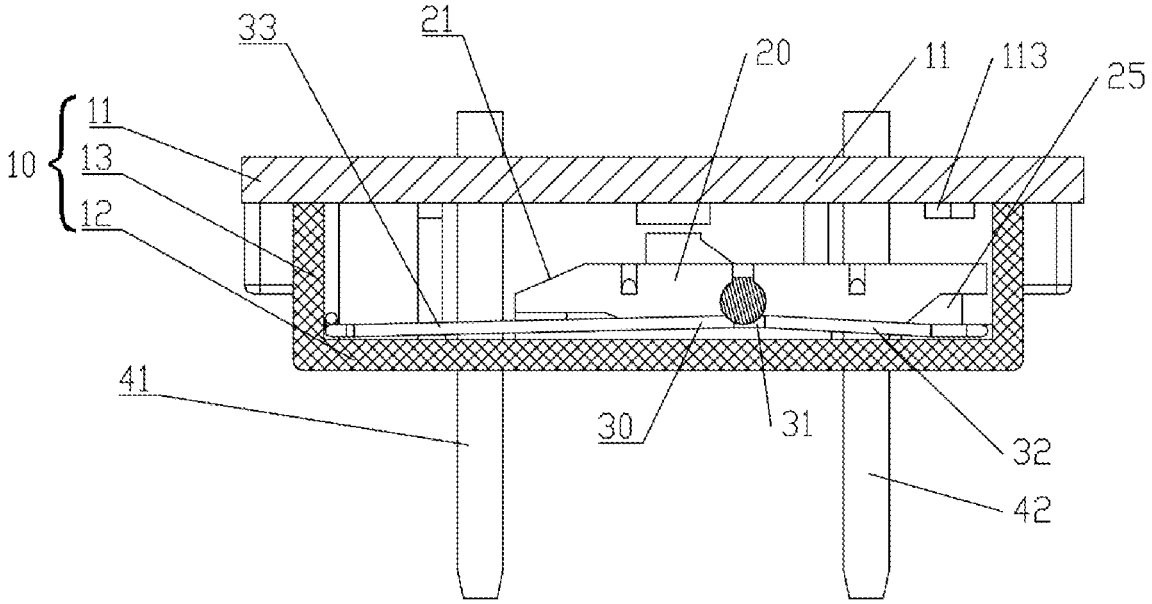
FIG. 5 is a cross-sectional view of the protection cover device for socket taken along direction A-A shown in the front view according to examples of the present disclosure (pressed state)
Figure 8:
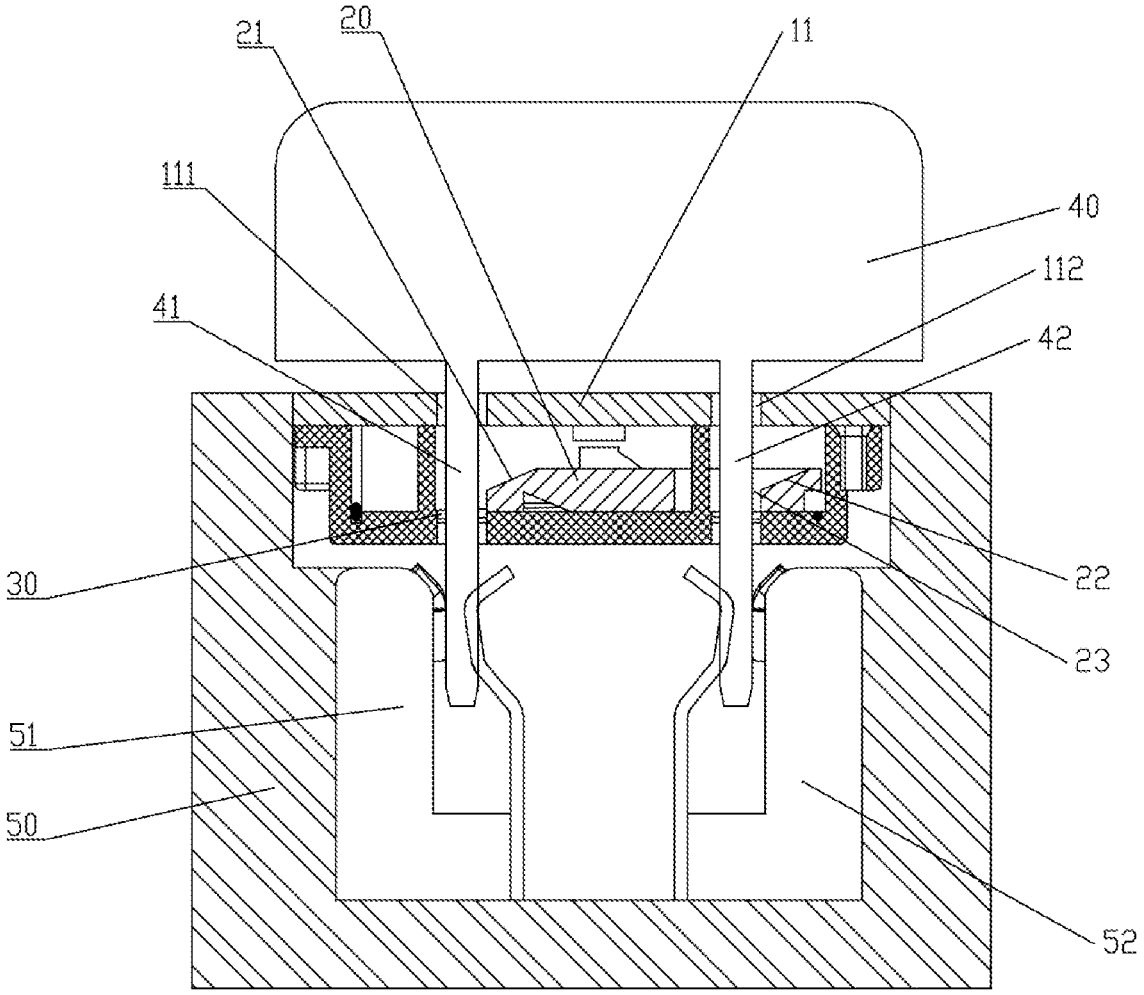
FIG. 8 is a cross-sectional view of a socket according to examples of the present disclosure.

The torsion spring 30 includes a spring body 31, a first swinging arm 32 fixedly connected to the spring body 31 and a second swinging arm 33 fixedly connected to the spring body 31. As shown in FIG. 2 and FIG. 4, in the example, the spring body 31 is composed of two curved sections made of elastic material, and the first swinging arm 32 and the second swinging arm 33 are connected to the spring body 31 respectively. In other examples, the spring body may also have a spiral shape. The torsion spring 30 is arranged between the protection cover 20 and the bottom plate 12, wherein the spring body 31 is lap-jointed or connected with the protection cover 20. The first swinging arm 31 is lap-jointed with a surface of the bottom plate 12 and slides along the surface of the bottom plate 12 when the protection cover 20 is pressed down and translated, the second swinging arm 33 is connected or lap-jointed with the bottom plate 12. In the example, the spring body 31 is lap-jointed with the protection cover 20, the first swinging arm 32 is lap jointed with the surface of the bottom plate 12, and the second swinging arm 33 is hingedly connected to the bottom plate 12. As shown in FIG. 5 and FIG. 8, when the first driving slope 21 and the second driving slope 22 are respectively pressed down at the same time by the first plug probe 41 and the second plug probe 42 in a balanced manner, the protection cover 20 exerts downward pressure to the torsion spring 30 to overcome the elastic force of the spring body 31 in the torsion spring 30, so that the first swinging arm 32 slides along the surface of the bottom plate 12, the angle between the first swinging arm 32 and the second swinging arm 33 becomes larger, the protection cover 20 translates downward, and the first plug probe 41 and the second plug probe 32 respectively slide along the first driving slope 21 and the second driving slope 22, until the first plug probe 41 slides out of the edge of the first driving slope 21, and the second plug probe 42 slides out of the second driving slope 22. At this time, the first plug probe 41 and the second plug probe 42 respectively extend from the first through hole 121 and the second through hole 122.

With the protection cover device for socket according to the present disclosure, the protection cover can only be opened when the first plug probe and the second plug probe simultaneously exert balanced downward pressure, so that the first plug probe and the second plug probe can pass through the first through hole and the second through hole to connect with the first socket sleeve and the second socket sleeve. When only the first plug probe or the second plug probe is inserted into the first insertion hole or the second insertion hole, because the protection cover does not subjected to balanced downward pressure, the protection cover will rotate, the first plug probe or the second plug probe cannot make the first driving slope or the second driving slope to push the protection cover to move, and the first plug probe or the second plug probe cannot pass through the first through hole or the second through hole to connect with the first socket sleeve or the second socket sleeve. The protection cover device for socket according to the present disclosure can prevent accidental insertion, has reliable performance, and prevent being stuck without affecting normal use.

Figure 6:
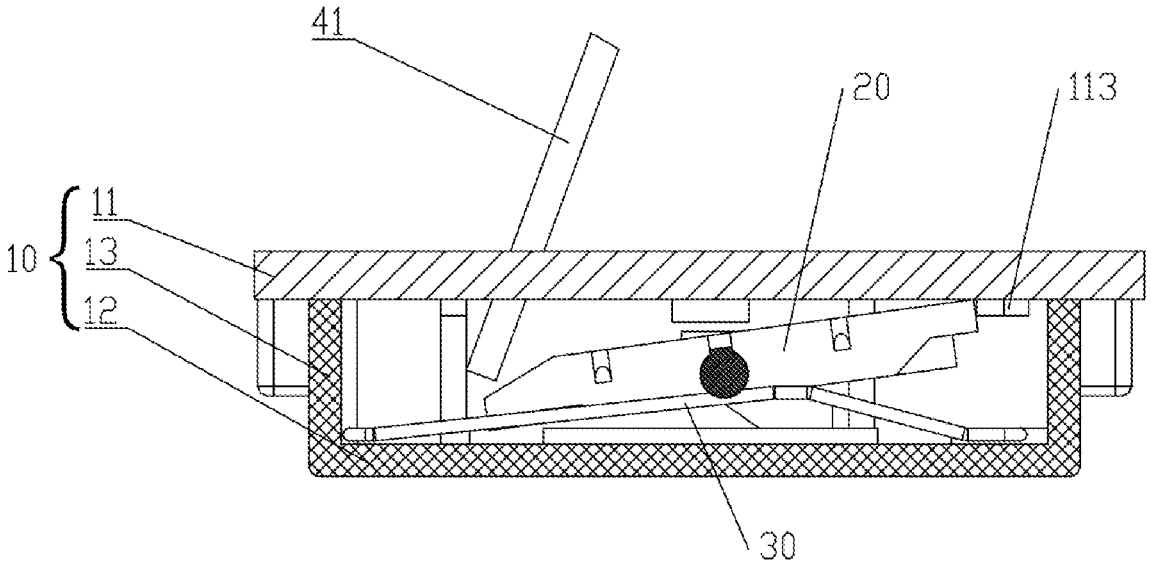
FIG. 6 is a cross-sectional view of the protection cover device for socket taken along direction A-A shown in the front view according to examples of the present disclosure (when only a first plug probe is pressed down)

As an example, as shown in FIG. 2, FIG. 4 and FIG. 6, the faceplate 11 is provided with a first stopper 113 that blocks a translation movement of the protection cover 20 when only the first driving slope 21 is pressed down. When only the first plug probe 41 is inserted into the first insertion hole 111, only the first driving slope 21 is pressed down by the first plug probe 41, the protection cover 20 cannot exert an effective downward pressure to the torsion spring 30, so that the protection cover 20 cannot translate downward, an end of the protection cover 20 provided with the first driving slope 21 is rotated downward, and another end of the protection cover 20 provided with the second driving slope 22 is rotated upward. At this time, the first stopper 113 blocks the protection cover 20 so that the protection cover 20 cannot move to the right, and the first plug probe 41 cannot pass through the first through hole 121. Furthermore, the protection cover 20 is provided with a second stopper 25 that blocks the translation movement of the protection cover 20 when only the second driving slope 22 is pressed down.

Figure 7:
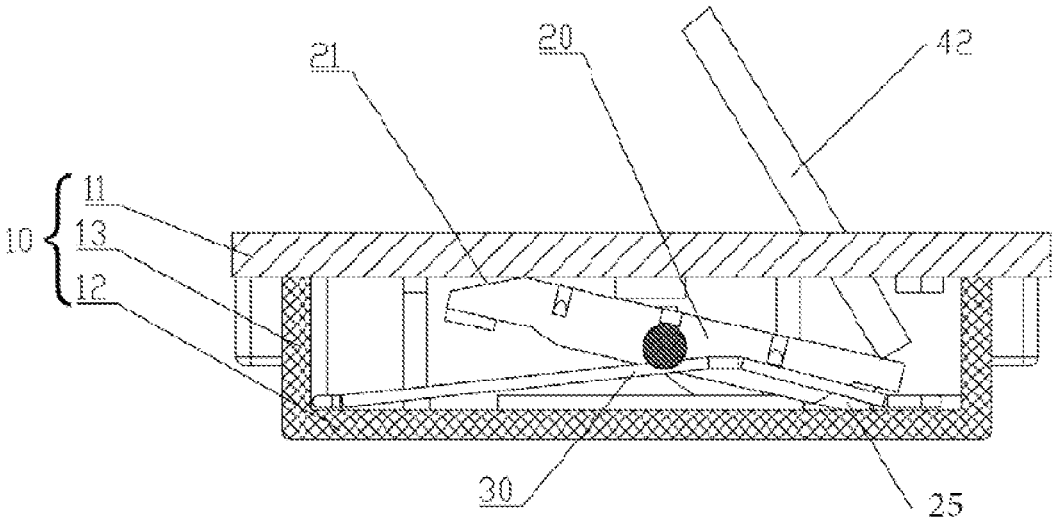
FIG. 7 is a cross-sectional view of the protection cover device for socket taken along direction A-A shown in the front view according to examples of the present disclosure (when only a second plug probe is pressed down)

As shown in FIG. 2, FIG. 4 and FIG. 7, when only the second driving slope 22 is pressed down by the second plug probe 42, the protection cover 20 cannot exert an effective downward pressure to the torsion spring 30, an end of the protection cover 20 provided with the second driving slope 22 is rotated downward, and another end of the protection cover 20 provided with the first driving slope 21 is rotated upward, the second stopper 25 is snapped into the second through hole 122, so that the protection cover 20 cannot move to the left, and the second plug probe 42 cannot pass through the second through hole 122.

Furthermore, as shown in FIG. 1 to FIG. 4, a shaft head 24 is provided at an end of the protection cover 20 perpendicular to the distribution direction of the first insertion hole 111 and the second insertion hole 112, the housing 10 includes an enclosure plate 13, an inner side wall of the enclosure plate 13 is provided with a sliding groove 131, and the sliding groove 131 is configured to guide the protection cover 20 to translate along a direction from the faceplate 11 to the bottom plate 12 and move along the distribution direction of the first insertion hole 111 and the second insertion hole 112. The shaft head 24 is arranged in the sliding groove 131. In the example, the sliding groove 131 is configured to extend obliquely along the distribution direction of the first insertion hole 111 and the second insertion hole 112 from an end close to the faceplate 11 to another end close to the bottom plate 12, that is, as shown in FIG. 2, the sliding groove 131 is inclined towards the bottom right direction from top to bottom.

In other examples, the sliding groove 131 has a narrower width at an end close to the faceplate 11 and a wider width at another end close to the bottom plate 12, that is, the sliding groove 131 is a structure with a wider lower part and a narrower upper part.

In order to allow the plug probes to pass through the first through hole 121 and the second through hole 122 smoothly, the first through hole 121 is aligned with the first insertion hole 111, and the second through hole 122 is aligned with the second insertion hole 112.

Furthermore, the enclosure plate 13 and the bottom plate 12 are integrated, and the faceplate 11 and the enclosure plate 13 are connected with each other by a buckle.

In order to facilitate the plug probes to pass through the through holes smoothly and accurately, the bottom plate 12 is provided with a first through hole guide plate 123 and a second through hole guide plate 124, the first through hole guide plate 123 is arranged on a side of the first through hole 121, and the second through hole guide plate 124 is arranged on a side of the second through hole 122.

A socket is further provided by the present disclosure, as shown in FIG. 8, the socket includes a socket container 50, a first socket sleeve 51 arranged in the socket container 50, a second socket sleeve 52 arranged in the socket container 50, and the protection cover device for socket according to the above examples. The first plug probe 41 and the second plug probe 42 of the plug 40 are respectively inserted into the first socket sleeve 51 and the second socket sleeve 52 through the protection cover device for socket.

The protection cover device for socket is arranged above the first socket sleeve 51 and the second socket sleeve 52, the first insertion hole 111 is aligned with the first socket sleeve 51, and the second insertion hole 112 is aligned with the second socket sleeve 52.

The present disclosure provides a protection cover for a socket, a socket and a method of manufacturing a socket.

The present disclosure provides a protection cover for a socket. A protection cover device for the socket may include a housing, a protection cover which is arranged in the housing, and a torsion spring which is configured to reset the protection cover, the housing includes a bottom plate and a faceplate spaced apart from the bottom plate, the faceplate is provided with a first insertion hole and a second insertion hole, the bottom plate is provided with a first through hole and a second through hole; the protection cover is further provided with a first driving slope and a second driving slope that guide the protection cover to translate along a distribution direction of the first insertion hole and the second insertion hole, the protection cover is further provided with a probe hole; the torsion spring includes a spring body, a first swinging arm fixedly connected to the spring body and a second swinging arm fixedly connected to the spring body, the torsion spring is arranged between the protection cover and the bottom plate, wherein the spring body is lap jointed or connected with the protection cover, the first swinging arm is lap-jointed with a surface of the bottom plate and is configured to slide along the surface of the bottom plate upon the protection cover being pressed down and translated, and the second swinging arm is connected or lap-jointed with the bottom plate.

The faceplate is provided with a first stopper that blocks a translation movement of the protection cover upon only the first driving slope being pressed down, the protection cover is provided with a second stopper that blocks the translation movement of the protection cover upon only the second driving slope being pressed down.

A shaft head is provided at an end of the protection cover perpendicular to the distribution direction of the first insertion hole and the second insertion hole, the housing includes an enclosure plate, an inner side wall of the enclosure plate is provided with a sliding groove, and the sliding groove is configured to guide the protection cover to translate along a direction from the faceplate to the bottom plate and move along the distribution direction of the first insertion hole and the second insertion hole, the shaft head is arranged in the sliding groove.

The sliding groove is configured to extend obliquely along the distribution direction of the first insertion hole and the second insertion hole from an end close to the faceplate to another end close to the bottom plate.

The sliding groove has a narrower width at an end close to the faceplate and a wider width at another end close to the bottom plate.

The first through hole is aligned with the first insertion hole, and the second through hole is aligned with the second insertion hole.

The enclosure plate and the bottom plate are integrated, and the faceplate and the enclosure plate are connected with each other by a buckle.

The bottom plate is provided with a first through hole guide plate and a second through hole guide plate, the first through hole guide plate is arranged on one side of the first through hole, and the second through hole guide plate is arranged on the said of the second through hole.

The present disclosure provides a socket. The socket may include a socket container, a first socket sleeve and a second socket sleeve arranged in the socket container, and the above-mentioned protection cover device for socket, the protection cover device is arranged above the socket sleeves, the first insertion hole is aligned with the first socket sleeve, and the second insertion hole is aligned with the second socket sleeve.

The present disclosure provides a method of manufacturing a socket. The method may include providing a socket container, and arranging a first socket sleeve and a second socket sleeve in the socket container; providing a protection cover device that comprises a housing, a protection cover which is arranged in the housing; and a torsion spring which is configured to reset the protection cover; providing the housing with a bottom plate and a faceplate spaced apart from the bottom plate, providing the faceplate with a first insertion hole and a second insertion hole, providing the bottom plate with a first through hole and a second through hole; providing the protection cover with a first driving slope and a second driving slope that guide the protection cover to translate along a distribution direction of the first insertion hole and the second insertion hole, providing the protection cover with a probe hole.

The method may also include providing the torsion spring with a spring body, a first swinging arm fixedly connected to the spring body and a second swinging arm fixedly connected to the spring body, and arranging the torsion spring between the protection cover and the bottom plate, and lap-jointing or connecting the spring body with the protection cover, where the first swinging arm may be lap jointed with a surface of the bottom plate and may be configured to slide along the surface of the bottom plate upon the protection cover being pressed down and translated, and connecting or lap jointing the second swinging arm with the bottom plate, and arranging the protection cover device above the first socket sleeve and the second socket sleeve, aligning the first insertion hole with the first socket sleeve, and aligning the second insertion hole with the second socket sleeve.

The method may include providing a shaft head at an end of the protection cover perpendicular to the distribution direction of the first insertion hole and the second insertion hole, providing the housing with an enclosure plate, providing an inner side wall of the enclosure plate with a sliding groove, and configuring the sliding groove to guide the protection cover to translate along a direction from the faceplate to the bottom plate and move along the distribution direction of the first insertion hole and the second insertion hole, and arranging the shaft head in the sliding groove.

The method may include integrating the enclosure plate and the bottom plate are integrated, and connecting the faceplate and the enclosure plate with each other by a buckle.

The method may also include aligning the first through hole with the first insertion hole, and aligning the second through hole is aligned with the second insertion hole.

Compared with the other implementations, the present disclosure has the following advantages: the protection cover device for socket according to the present disclosure can prevent accidental insertion, has reliable performance, and prevent being stuck without affecting normal use.

It should be noted that the examples of the present disclosure include examples, the examples of the present disclosure are not intended to limit the present disclosure in any form. Any person skilled in the art may use the technical content disclosed above to change or modify into equivalent effective examples. Without departing from the content of the technical solution in the present disclosure, any amendments or equivalent changes and modifications made to the above examples based on the technical content of the present disclosure still fall within the scope of the present disclosure.

What is claimed is:

1. A protection cover device for a socket, comprising:

a housing;

a protection cover, which is arranged in the housing; and a torsion spring, which is configured to reset the protection cover, and wherein the housing further comprises a bottom plate and a faceplate spaced apart from the bottom plate, the faceplate is provided with a first insertion hole and a second insertion hole, the bottom plate is provided with a first through hole and a second through hole; the protection cover is further provided with a first driving slope and a second driving slope that guide the protection cover to translate along a distribution direction of the first insertion hole and the second insertion hole, the protection cover is further provided with a probe hole; the torsion spring comprises a spring body, a first swinging arm fixedly connected to the spring body and a second swinging arm fixedly connected to the spring body, the torsion spring is arranged between the protection cover and the bottom plate, and wherein the spring body is lap-jointed or connected with the protection cover, the first swinging arm is lap jointed with a surface of the bottom plate and is configured to slide along the surface of the bottom plate upon the protection cover being pressed down and translated, and the second swinging arm is connected or lap jointed with the bottom plate.

2. The protection cover device for socket according to claim 1, wherein the faceplate is provided with a first stopper that blocks a translation movement of the protection cover upon only the first driving slope being pressed down, and the protection cover is provided with a second stopper that blocks the translation movement of the protection cover upon only the second driving slope being pressed down.

3. The protection cover device for socket according to claim 1, wherein the first through hole is aligned with the first insertion hole, and the second through hole is aligned with the second insertion hole.

4. The protection cover device for socket according to claim 1, wherein the bottom plate is provided with a first through hole guide plate and a second through hole guide plate, the first through hole guide plate is arranged on a side of the first through hole, and the second through hole guide plate is arranged on a side of the second through hole.

5. The protection cover device for socket according to claim 1, wherein:

a shaft head is provided at an end of the protection cover perpendicular to the distribution direction of the first insertion hole and the second insertion hole, the housing comprises an enclosure plate, an inner side wall of the enclosure plate is provided with a sliding groove, and the sliding groove is configured to guide the protection cover to translate along a direction from the faceplate to the bottom plate and move along the distribution direction of the first insertion hole and the second insertion hole, and the shaft head is arranged in the sliding groove.

6. The protection cover device for socket according to claim 5, wherein the sliding groove is configured to extend obliquely along the distribution direction of the first insertion hole and the second insertion hole from an end close to the faceplate to another end close to the bottom plate.

7. The protection cover device for socket according to claim 5, wherein the sliding groove has a narrower width at an end close to the faceplate and a wider width at another end close to the bottom plate.

8. The protection cover device for socket according to claim 5, wherein the enclosure plate and the bottom plate are integrated, and the faceplate and the enclosure plate are connected with each other by a buckle.

9. A socket, comprising:

a socket container;

a first socket sleeve and a second socket sleeve arranged in the socket container; and a protection cover device comprising a housing; a protection cover, which is arranged in the housing; and a torsion spring, which is configured to reset the protection cover, and wherein:

the housing further comprises a bottom plate and a faceplate spaced apart from the bottom plate, the faceplate is provided with a first insertion hole and a second insertion hole, the bottom plate is provided with a first through hole and a second through hole; the protection cover is further provided with a first driving slope and a second driving slope that guide the protection cover to translate along a distribution direction of the first insertion hole and the second insertion hole, the protection cover is further provided with a probe hole; the torsion spring comprises a spring body, a first swinging arm fixedly connected to the spring body and a second swinging arm fixedly connected to the spring body, the torsion spring is arranged between the protection cover and the bottom plate, and the spring body is lap jointed or connected with the protection cover, the first swinging arm is lap jointed with a surface of the bottom plate and is configured to slide along the surface of the bottom plate upon the protection cover being pressed down and translated, and the second swinging arm is connected or lap jointed with the bottom plate, and the protection cover device is arranged above the first socket sleeve and the second socket sleeve, the first insertion hole is aligned with the first socket sleeve, and the second insertion hole is aligned with the second socket sleeve.

10. The socket of claim 9, wherein the faceplate is provided with a first stopper that blocks a translation movement of the protection cover upon only the first driving slope being pressed down, and the protection cover is provided with a second stopper that blocks the translation movement of the protection cover upon only the second driving slope being pressed down.

11. The socket of claim 9, wherein:

a shaft head is provided at an end of the protection cover perpendicular to the distribution direction of the first insertion hole and the second insertion hole, the housing comprises an enclosure plate, an inner side wall of the enclosure plate is provided with a sliding groove, and the sliding groove is configured to guide the protection cover to translate along a direction from the faceplate to the bottom plate and move along the distribution direction of the first insertion hole and the second insertion hole, and the shaft head is arranged in the sliding groove.

12. The socket of claim 11, wherein the sliding groove is configured to extend obliquely along the distribution direction of the first insertion hole and the second insertion hole from an end close to the faceplate to another end close to the bottom plate.

13. The socket of claim 11, wherein the sliding groove has a narrower width at an end close to the faceplate and a wider width at another end close to the bottom plate.

14. A method of manufacturing a socket, comprising:

providing a socket container, and arranging a first socket sleeve and a second socket sleeve in the socket container;

providing a protection cover device that comprises a housing, a protection cover which is arranged in the housing; and a torsion spring which is configured to reset the protection cover;

providing the housing with a bottom plate and a faceplate spaced apart from the bottom plate, providing the faceplate with a first insertion hole and a second insertion hole, providing the bottom plate with a first through hole and a second through hole;

providing the protection cover with a first driving slope and a second driving slope that guide the protection cover to translate along a distribution direction of the first insertion hole and the second insertion hole, providing the protection cover with a probe hole;

providing the torsion spring with a spring body, a first swinging arm fixedly connected to the spring body and a second swinging arm fixedly connected to the spring body, and arranging the torsion spring between the protection cover and the bottom plate, and lap-jointing or connecting the spring body with the protection cover, wherein the first swinging arm is lap jointed with a surface of the bottom plate and is configured to slide along the surface of the bottom plate upon the protection cover being pressed down and translated, and connecting or lap-jointing the second swinging arm with the bottom plate, and arranging the protection cover device above the first socket sleeve and the second socket sleeve, aligning the first insertion hole with the first socket sleeve, and aligning the second insertion hole with the second socket sleeve.

15. The method of claim 14, further comprising:

aligning the first through hole with the first insertion hole, and aligning the second through hole is aligned with the second insertion hole.

16. The method of claim 14, further comprising:

providing a shaft head at an end of the protection cover perpendicular to the distribution direction of the first insertion hole and the second insertion hole, providing the housing with an enclosure plate, providing an inner side wall of the enclosure plate with a sliding groove, and configuring the sliding groove to guide the protection cover to translate along a direction from the faceplate to the bottom plate and move along the distribution direction of the first insertion hole and the second insertion hole, and arranging the shaft head in the sliding groove.

17. The method of claim 16, further comprising:

integrating the enclosure plate and the bottom plate are integrated, and connecting the faceplate and the enclosure plate with each other by a buckle.

* * * * *